US009053670B2

(12) United States Patent
Zhang

(10) Patent No.: US 9,053,670 B2
(45) Date of Patent: Jun. 9, 2015

(54) LIQUID CRYSTAL DISPLAY APPARATUS AND LED BACKLIGHT MODULE THEREOF

(71) Applicant: Shenzhen China Star Optoelectronics Technology Co., Ltd., Shenzhen, Guangdong (CN)

(72) Inventor: Hua Zhang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 190 days.

(21) Appl. No.: 13/876,483

(22) PCT Filed: Mar. 13, 2013

(86) PCT No.: PCT/CN2013/072543

§ 371 (c)(1),
(2) Date: Mar. 28, 2013

(87) PCT Pub. No.: WO2014/139104

PCT Pub. Date: Sep. 18, 2014

(65) Prior Publication Data

US 2014/0253840 A1 Sep. 11, 2014

(51) Int. Cl.
*G09G 3/34* (2006.01)
*H05B 33/08* (2006.01)

(52) U.S. Cl.
CPC ..... *G09G 3/34* (2013.01); *H05B 33/0815* (2013.01)

(58) Field of Classification Search
CPC ..... H05B 33/0809; G02F 1/133603
USPC ..... 315/185 R
See application file for complete search history.

(56) References Cited

U.S. PATENT DOCUMENTS

| | | | | |
|---|---|---|---|---|
| 7,804,258 | B2 * | 9/2010 | Zhao | 315/307 |
| 2004/0251854 | A1 * | 12/2004 | Matsuda et al. | 315/291 |
| 2008/0018266 | A1 * | 1/2008 | Yu et al. | 315/291 |
| 2009/0128045 | A1 * | 5/2009 | Szczeszynski et al. | 315/185 R |
| 2012/0086357 | A1 * | 4/2012 | Tseng | 315/294 |
| 2012/0133291 | A1 * | 5/2012 | Kitagawa et al. | 315/186 |
| 2012/0146541 | A1 * | 6/2012 | Szczeszynski et al. | 315/294 |
| 2013/0113841 | A1 * | 5/2013 | Choi et al. | 345/690 |

FOREIGN PATENT DOCUMENTS

CN 101340760 A 1/2009

* cited by examiner

*Primary Examiner* — Douglas W Owens
*Assistant Examiner* — Pedro C Fernandez
(74) *Attorney, Agent, or Firm* — Andrew C. Cheng

(57) ABSTRACT

A liquid crystal display apparatus includes an LED backlight module incorporated therein, and the LED backlight module includes a boosting circuit for receiving a direct current voltage, boosting the direct current voltage, and then outputting a step-up direct current voltage; an LED string, including a plurality of LEDs connected in series, for receiving the step-up direct current voltage from the boosting circuit; a constant current driver circuit for generating a signal used for controlling the boosting circuit; and a amplified circuit for receiving the direct current voltage, magnifying the signal from the constant current driver circuit, and then outputting a magnified signal to the boosting circuit. The power consumption of the boosting circuit is reduced by adding the amplified circuit for amplifying a driving voltage to the boosting circuit. Furthermore, the driving voltage input to the MOS transistor of the boosting circuit is amplified by the amplified circuit, and thereby the value of the DCR value of the MOS transistor is reduced. The power consumption of the MOS transistor is reduced, and the temperature is lowered, so the lifespan of the MOS transistor is extended.

18 Claims, 2 Drawing Sheets

LIQUID CRYSTAL DISPLAY APPARATUS AND LED BACKLIGHT MODULE THEREOF

FIELD OF THE INVENTION

The present invention relates to a technical field of liquid crystal display, and more particularly to a liquid crystal display apparatus and an LED backlight module incorporated therein.

BACKGROUND OF THE INVENTION

As the technology continues to progress, the technology of the backlight for illuminating a liquid crystal display apparatus also continues to develop. The typical and conventional backlight module of the existing liquid crystal display apparatus utilizes a cold cathode fluorescent lamp (CCFL) as a light source. However, as known to the skilled in the art, that the disadvantages of a CCFL backlight module include poor color reproduction capability, low luminous efficiency, high discharging voltage, poor discharge characteristics at low temperature, and a prolonged warming up time to reach stable grey scale. Currently, the technology of using an LED backlight module has been developed.

However, in an existing driver circuit of an LED backlight module, such as shown in FIG. 1, a constant current driver circuit 13 outputs a signal (i.e. driving signal) to a gate of a MOS transistor Q of a boosting circuit 11. When the MOS transistor Q operates, an internal equivalent direct current resistance (DCR) is generated, and the value of the DCR is reduced with the increase of the voltage between the gate and the source of the MOS transistor Q. Once the MOS transistor Q is turned on, an electric current flow through the gate and the source, and the MOS transistor Q will consume power due to the existence of the equivalent direct current resistance (DCR). In light of this, the lifespan of the MOS transistor Q decreases resulted from the increase of the temperature, and thereby the lifespan of the boosting circuit also decreases due to the increase of the power consumption.

SUMMARY OF THE INVENTION

In order to resolve the technical issue encountered by the prior art, the present invention provides an LED backlight module for illuminating a liquid crystal display apparatus, including a boosting circuit for receiving a direct current voltage, boosting the direct current voltage, and then outputting a step-up direct current voltage; an LED string, including a sixth resistor and a plurality of LEDs connected in series, for receiving the step-up direct current voltage from the boosting circuit; a constant current driver circuit for generating a signal used for controlling the boosting circuit; and a amplifying circuit for receiving the direct current voltage, amplifying the signal from the constant current driver circuit, and then outputting a magnified signal to the boosting circuit.

The present invention further provides a liquid crystal display apparatus, including a liquid crystal display panel and an LED backlight module disposed relative to the liquid crystal display panel for projecting luminous light toward the panel so as to display the patterns on the panel, wherein the LED backlight module comprises a boosting circuit for receiving a direct current voltage, boosting the direct current voltage, and then outputting a step-up direct current voltage; an LED string, including a sixth resistor and a plurality of LEDs connected in series, for receiving the step-up direct current voltage from the boosting circuit; a constant current driver circuit for generating a signal used for controlling the boosting circuit; and a amplifying circuit for receiving the direct current voltage, amplifying the signal from the constant current driver circuit, and then outputting a magnified signal to the boosting circuit.

In addition, the amplifying circuit includes a first resistor, a second resistor, a third resistor, a fourth resistor, a fifth resistor, a first transistor, and a second transistor; wherein a first end of the first resistor connects to a first end of the third resistor and receives the direct current voltage; wherein a second end of the first resistor connects to the boosting circuit; wherein a second end of the third resistor connects to a collector of the first transistor; wherein a base of the first transistor connects to one end of the fifth resistor and the constant current driver circuit; wherein the other end of the fifth resistor connects to an emitter of the first transistor and electrically grounds; wherein a base of the second transistor connects to one end of the fourth resistor and the collector of the first transistor; wherein a collector of the second transistor connects to one end of the second resistor and the second end of the first resistor; wherein an emitter of the second transistor connects to the other end of the second resistor and the other end of the fourth resistor; and wherein the other end of the fourth resistor electrically grounds.

Moreover, the amplifying circuit amplifies the signal from the constant current driver circuit by increasing the resistance value of the second resistor and/or reducing the resistance value of the first resistor.

Furthermore, the boosting circuit includes an inductor, a MOS transistor, a rectifier diode, and a capacitor; wherein one end of the inductor receives the direct current voltage; wherein the other end of the inductor connects to a positive electrode of the rectifier diode; wherein a drain of the MOS transistor is arranged between the inductor and the positive electrode of the rectifier diode; wherein one end of the capacitor connects to a negative electrode of the rectifier diode and a positive electrode of the LED string; wherein the other end of the capacitor connects to a source of the MOS transistor; and wherein a gate of the MOS transistor connects to the other end of the first resistor in the amplifying circuit.

Besides, the constant current driver circuit includes an oscillator for generating a triangular wave signal; a seventh resistor for limiting the frequency of the triangular wave signal; a comparator for comparing the voltage of the triangular wave signal and the voltage of both ends of the sixth resistor in the LED string; wherein when the voltage of the triangular wave signal is higher than the voltage of both ends of the sixth resistor in the LED string, an output terminal of the comparator outputs a first signal to the base of the first transistor in the amplifying circuit; and wherein when the triangular wave signal is lower than the voltage of both ends of the sixth resistor in the LED string, an output terminal of the comparator outputs a second signal to the base of the first transistor in the amplifying circuit.

In addition, the first signal is a high-level signal and the second signal is a low-level signal.

Moreover, the frequency of the magnified signal output from the magnified circuit is identical to the frequency of the signal output from the constant current driver circuit, and the duty factor of the magnified signal output from the magnified circuit is also identical to the duty factor of the signal output from the constant current driver circuit.

Furthermore, the direct current voltage is converted from an external alternating current voltage which is supplied from external power source of the liquid crystal display apparatus.

According to the liquid crystal display apparatus and the LED backlight module incorporated therein of the present invention, the power consumption of the boosting circuit is reduced by adding the amplifying circuit for amplifying a driving voltage to the boosting circuit. Furthermore, the driving voltage input to the MOS transistor of the boosting circuit is amplified by the amplifying circuit, and thereby the value of the DCR value of the MOS transistor is reduced. As a result, the power consumption of the MOS transistor is reduced, and the temperature is lowered, so the lifespan of the MOS transistor is extended.

DETAILED DESCRIPTION OF PREFERRED EMBODIMENT

Now, a detailed description will be given with respect to preferred embodiments provided and illustrated here below in accompanied drawings. The legends are shown in the accompanied drawings, wherein the same legends always indicate the same or the substantially identical parts. In order to give a better and thorough understanding to the whole and other intended purposes, features and advantages of the present invention or the technical solution of the prior art, detailed description will be given with respect to preferred embodiments provided and illustrated here below in accompanied drawings. It is an object of the following description to avoid the confusion of the concept of the present invention resulted from the unnecessary detailed description of the known structure and/or function in which the unnecessary detailed description of the known structure and/or function can be omitted.

Figure 1:
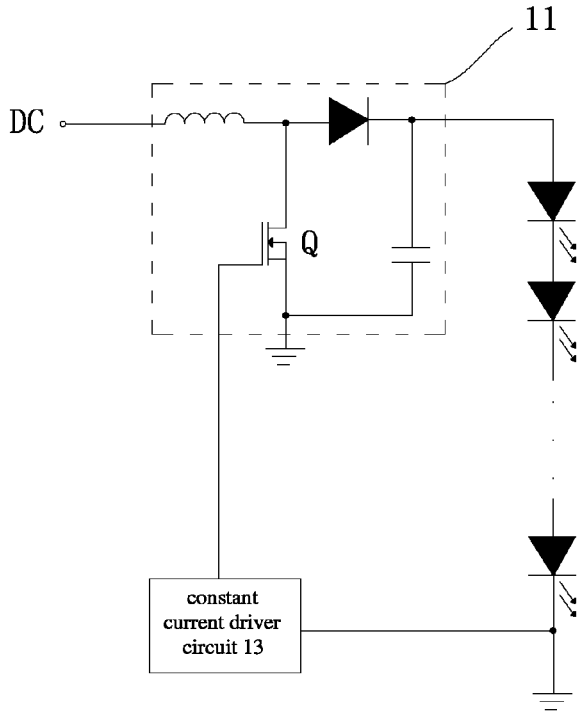
FIG. 1 is an illustrational view of a prior art LED backlight module for illuminating a liquid crystal display apparatus.
Figure 2:
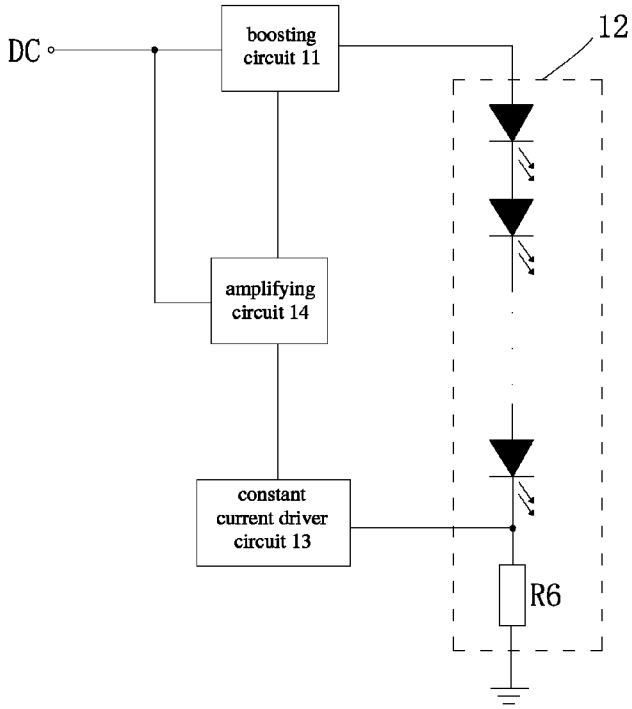
FIG. 2 is a structural and illustrational view of an LED backlight module for illuminating a liquid crystal display apparatus made in accordance with the present invention.

FIG. 2 is a structural and illustrational view of an LED backlight module for illuminating a liquid crystal display apparatus made in accordance with the present invention.

As shown in FIG. 2, the LED backlight module made in accordance with the present invention includes a boosting circuit 11, an LED string 12, a constant current driver circuit 13, and a amplifying circuit 14.

The boosting circuit 11 receives a direct current (DC) voltage (i.e. 24V), and boosts the direct current (DC) voltage, and then outputs a step-up direct current voltage. The direct current (DC) voltage is converted from an alternating current voltage (i.e. 110V or 220V). For example, the alternating current voltage can be converted to the direct current (DC) voltage by an existing AC to DC converter circuit.

The LED string 12 is disposed in a rear of a liquid crystal display panel of a liquid crystal display apparatus and serves as the backlight, and the LED string 12 includes a plurality of LEDs and a sixth resistor R6 connected in series. The LED string 12 receives the direct current voltage from the boosting circuit 11. It should be noted that the normal direct current voltage for illuminating the LED string 12 should less than the step-up direct current voltage output from the boosting circuit 11.

Alternatively, the sixth resistor R6 can be excluded from the LED string.

The constant current driver circuit 13 generates a signal used for controlling the boosting circuit 11.

The amplifying circuit 14 receives the direct current (DC) voltage, magnifies the signal from the constant current driver circuit 13, and then outputs a magnified signal to the boosting circuit 11. The magnified signal is also a driving signal for the boosting circuit 11 outputting the step-up direct current voltage to the LED string 12.

Figure 3:
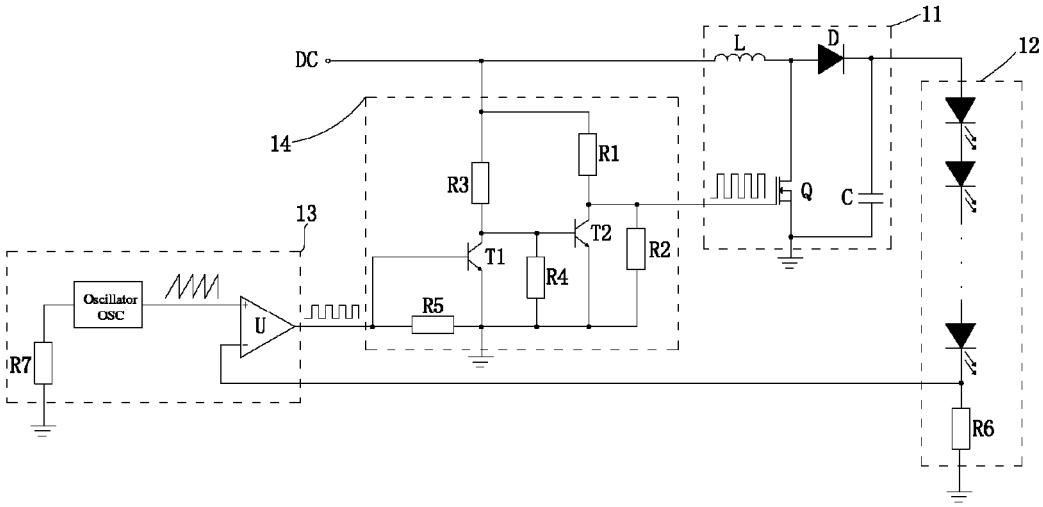
FIG. 3 is a structural and illustrational view of a boosting circuit, a constant current driver circuit, and a amplifying circuit of the LED backlight module made in accordance with the present invention.

FIG. 3 is a structural and illustrational view of a boosting circuit, a constant current driver circuit, and a amplifying circuit of the LED backlight module made in accordance with the present invention.

The boosting circuit 11 of the LED backlight module made in accordance with the present invention includes an inductor L, a metal oxide semiconductor (MOS) transistor Q, a rectifier diode D, and a capacitor C.

One end of the inductor L receives the direct current (DC) voltage; wherein the other end of the inductor L connects to a positive electrode of the rectifier diode D; wherein a drain of the MOS transistor Q is arranged between the inductor L and the positive electrode of the rectifier diode D; wherein one end of the capacitor C connects to a negative electrode of the rectifier diode D and a positive electrode of the LED string 12; wherein the other end of the capacitor C connects to a source of the MOS transistor Q; and wherein a gate of the MOS transistor Q connects to the other end of the first resistor in the amplifying circuit 14.

Outputting the step-up direct current voltage from the boosting circuit 11 to the LED string 12 can be controlled by the magnified signal from the amplifying circuit 14 via driving the gate of the MOS transistor Q.

The constant current driver circuit 13 of the LED backlight module made in accordance with the present invention includes an oscillator OSC, a seventh resistor R7, and a comparator U.

Wherein a first end of the oscillator OSC connects to the seventh resistor R7; wherein a second end of the oscillator OSC connects to a positive end of the comparator U; wherein a negative end of the comparator U is arranged between a negative end of the LED string 12 and the sixth resistor R6; and wherein an output terminal of the comparator U connects to a base of a first transistor T1 in the amplifying circuit 14.

The oscillator OSC is used for generating a triangular wave signal; the seventh resistor R7 is used for limiting the frequency of the triangular wave signal; the comparator U is used for comparing the voltage of the triangular wave signal and the voltage of both ends of the sixth resistor R6 in the LED string 12; wherein when the voltage of the triangular wave signal is higher than the voltage of both ends of the sixth resistor R6 in the LED string 12, an output terminal of the comparator U outputs a first signal to the base of the first transistor T1 in the amplifying circuit 14; and wherein when the triangular wave signal is lower than the voltage of both ends of the sixth resistor R6 in the LED string 12, an output terminal of the comparator U outputs a second signal to the base of the first transistor T1 in the amplifying circuit 14.

It should be understood that the first signal could be a high-level signal and the second signal could be a low-level signal. Alternatively, the first signal could be a low-level signal and the second signal could be a high-level signal.

The amplifying circuit 14 of the LED backlight module made in accordance with the present invention includes a first resistor R1, a second resistor R2, a third resistor R3, a fourth resistor R4, a fifth resistor R5, a first transistor T1, and a second transistor T2.

A first end of the first resistor R1 connects to a first end of the third resistor R3 and receives the direct current voltage; wherein a second end of the first resistor R1 connects to the gate of the MOS transistor Q in the boosting circuit 11; wherein a second end of the third resistor R3 connects to a collector of the first transistor T1; wherein a base of the first transistor T1 connects to one end of the fifth resistor R5 and the constant current driver circuit 13; wherein the other end of the fifth resistor R5 connects to an emitter of the first transistor T1 and electrically grounds; wherein a base of the second transistor T2 connects to one end of the fourth resistor R4 and the collector of the first transistor T1; wherein a collector of the second transistor T2 connects to one end of the second resistor R2 and the second end of the first resistor R1; wherein an emitter of the second transistor T2 connects to the other end of the second resistor R2 and the other end of the fourth resistor R4; and wherein the other end of the fourth resistor R4 electrically grounds.

When a signal output from the output terminal of the comparator U in the constant current driver circuit 13 is a low-level signal, the first transistor T1 is not turned on, and the second transistor T2 is turned on. In addition, the voltage of the gate of the MOS transistor Q in the boosting circuit 11 is zero, and the MOS transistor Q is not turned on. In light of this, the boosting circuit 11 stopped boosting the direct current (DC) voltage, and the voltage as well as the current of the LED string 12 decreases, so the brightness of the LED string 12 also decreases.

When a signal output from the output terminal of the comparator U in the constant current driver circuit 13 is a high-level signal, the first transistor T1 is turned on, and the second transistor T2 is not turned on, so the direct current (DC) voltage through the first resistor R1 and the second resistor R2 is divided to the gate of the MOS transistor Q. By adjusting the resistance value of the first resistor R1 and/or the resistance value of the second resistor R2, the high-level signal output from the output terminal of the comparator U can be converted to a higher-level signal, which means that the high-level signal output from the output terminal of the comparator U is amplified as a magnified high-level signal. The concrete conversion equation is as follows:

$$QGC = Va \times \frac{R_2}{R_1 + R_2}.$$

Wherein the voltage value of the direct current (DC) voltage is Va; the voltage value of the magnified high-level signal to the gate of the MOS transistor Q is QGC; the resistance value of the first resistor R1 is $R_1$; and the resistance value of the second resistor R2 is $R_2$.

As shown and illustrated in the above equation, the signal from the constant current driver circuit 13 can be amplified by increasing the resistance value $R_2$ of the second resistor R2 and/or reducing the resistance value $R_1$ of the first resistor R1. For example, when Va=24V, $R_1$=1Ω, $R_2$=2Ω, and OGC=16V.

Generally, the voltage value of the high-level signal output from the output terminal of the comparator U is 5V. If the output terminal of the comparator U directly connects to the gate of the MOS transistor Q, the voltage value of the high-level signal to the gate of the MOS transistor Q will be 5V. However, as shown in the above equation, the voltage value of the high-level signal to the gate of the MOS transistor Q could be greatly increased in the present invention. As a result, when driving the MOS transistor Q, the DCR value of the MOS transistor Q decreases, and thereby the power consumption as well as the temperature of the MOS transistor Q lowers, so the lifespan of the MOS transistor Q is extended.

It should be noted that the frequency of the magnified signal output from the magnified circuit 14 is identical to the frequency of the signal output from the constant current driver circuit 13, and the duty factor of the magnified signal output from the magnified circuit 14 is also identical to the duty factor of the signal output from the constant current driver circuit 13.

Figure 4:
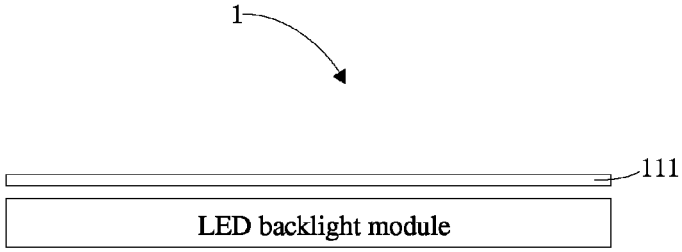
FIG. 4 is a structural and illustrational view of a liquid crystal display apparatus equipped with the LED backlight module made in accordance with the present invention.

FIG. 4 is a structural and illustrational view of a liquid crystal display apparatus equipped with the LED backlight module made in accordance with the present invention.

As shown in FIG. 4, a liquid crystal display apparatus 1 includes a liquid crystal display panel 111 and an LED backlight module disposed relative to the liquid crystal display panel 111 for projecting luminous light toward the panel 111 so as to display the patterns on the panel 111.

In summary, according to the liquid crystal display apparatus and the LED backlight module incorporated therein of the present invention, the power consumption of the boosting circuit is reduced by adding the amplifying circuit for amplifying a driving voltage to the boosting circuit. Furthermore, the driving voltage input to the MOS transistor of the boosting circuit is amplified by the amplifying circuit, and thereby the value of the DCR value of the MOS transistor is reduced. As a result, the power consumption of the MOS transistor is reduced, and the temperature is lowered, so the lifespan of the MOS transistor is extended.

Although embodiments of the present invention have been described, persons of the skilled in the art should understand that any modification of equivalent structure or equivalent process without departing from the spirit and scope of the present invention limited by the claims is allowed.

The invention claimed is:

1. An LED backlight module, used for a liquid crystal display apparatus, comprising:

a boosting circuit for receiving a direct current voltage, boosting the direct current voltage, and then outputting a step-up direct current voltage;

an LED string, including a sixth resistor and a plurality of LEDs connected in series, for receiving the step-up direct current voltage from the boosting circuit;

a constant current driver circuit for generating a signal used for controlling the boosting circuit;

a amplifying circuit for receiving the direct current voltage, amplifying the signal from the constant current driver circuit, and then outputting a magnified signal to the boosting circuit;

wherein the amplifying circuit includes a first resistor, a second resistor, a third resistor, a fourth resistor, a fifth resistor, a first transistor, and a second transistor;

wherein a first end of the first resistor connects to a first end of the third resistor and receives the direct current voltage; wherein a second end of the first resistor connects to the boosting circuit; wherein a second end of the third resistor connects to a collector of the first transistor; wherein a base of the first transistor connects to one end of the fifth resistor and the constant current driver circuit; wherein the other end of the fifth resistor connects to an emitter of the first transistor and electrically grounds; wherein a base of the second transistor connects to one end of the fourth resistor and the collector of the first transistor; wherein a collector of the second transistor connects to one end of the second resistor and the second end of the first resistor; wherein an emitter of the second transistor connects to the other end of the second resistor and the other end of the fourth resistor; and wherein the other end of the fourth resistor electrically grounds.

2. The LED backlight module as recited in claim 1, wherein the amplifying circuit amplifies the signal from the constant current driver circuit by increasing the resistance value of the second resistor.

3. The LED backlight module as recited in claim 1, wherein the amplifying circuit amplifies the signal from the constant current driver circuit by reducing the resistance value of the first resistor.

4. The LED backlight module as recited in claim 1, wherein the amplifying circuit amplifies the signal from the constant current driver circuit by increasing the resistance value of the second resistor and reducing the resistance value of the first resistor.

5. The LED backlight module as recited in claim 1, wherein the boosting circuit includes an inductor, a MOS transistor, a rectifier diode, and a capacitor;

wherein one end of the inductor receives the direct current voltage; wherein the other end of the inductor connects to a positive electrode of the rectifier diode; wherein a drain of the MOS transistor is arranged between the inductor and the positive electrode of the rectifier diode;

wherein one end of the capacitor connects to a negative electrode of the rectifier diode and a positive electrode of the LED string; wherein the other end of the capacitor connects to a source of the MOS transistor; and wherein a gate of the MOS transistor connects to the other end of the first resistor in the amplifying circuit.

6. The LED backlight module as recited in claim 5, wherein the constant current driver circuit includes an oscillator for generating a triangular wave signal;

a seventh resistor for limiting the frequency of the triangular wave signal;

a comparator for comparing the voltage of the triangular wave signal and the voltage of both ends of the sixth resistor in the LED string;

wherein when the voltage of the triangular wave signal is higher than the voltage of both ends of the sixth resistor in the LED string, an output terminal of the comparator outputs a first signal to the base of the first transistor in the amplifying circuit; and wherein when the triangular wave signal is lower than the voltage of both ends of the sixth resistor in the LED string, an output terminal of the comparator outputs a second signal to the base of the first transistor in the amplifying circuit.

7. The LED backlight module as recited in claim 6, wherein the first signal is a high-level signal and the second signal is a low-level signal.

8. The LED backlight module as recited in claim 1, wherein a frequency of the magnified signal output from the amplified circuit is identical to the frequency of the signal output from the constant current driver circuit, and the duty factor of the magnified signal output from the magnified circuit is also identical to a duty factor of the signal output from the constant current driver circuit.

9. The LED backlight module as recited in claim 1, wherein the direct current voltage is converted from an external alternating current voltage which is outside of the liquid crystal display apparatus.

10. A liquid crystal display apparatus, including a liquid crystal display panel and an LED backlight module disposed relative to the liquid crystal display panel for projecting luminous light toward the panel so as to display the patterns on the panel, wherein the LED backlight module comprises a boosting circuit for receiving a direct current voltage, boosting the direct current voltage, and then outputting a step-up direct current voltage;

an LED string, including a sixth resistor and a plurality of LEDs connected in series, for receiving the step-up direct current voltage from the boosting circuit;

a constant current driver circuit for generating a signal used for controlling the boosting circuit; and a amplifying circuit for receiving the direct current voltage, amplifying the signal from the constant current driver circuit, and then outputting a magnified signal to the boosting circuit;

wherein the amplifying circuit includes a first resistor, a second resistor, a third resistor, a fourth resistor, a fifth resistor, a first transistor, and a second transistor;

wherein a first end of the first resistor connects to a first end of the third resistor and receives the direct current voltage; wherein a second end of the first resistor connects to the boosting circuit; wherein a second end of the third resistor connects to a collector of the first transistor; wherein a base of the first transistor connects to one end of the fifth resistor and the constant current driver circuit; wherein the other end of the fifth resistor connects to an emitter of the first transistor and electrically grounds; wherein a base of the second transistor connects to one end of the fourth resistor and the collector of the first transistor; wherein a collector of the second transistor connects to one end of the second resistor and the second end of the first resistor; wherein an emitter of the second transistor connects to the other end of the second resistor and the other end of the fourth resistor; and wherein the other end of the fourth resistor electrically grounds.

11. The liquid crystal display apparatus as recited in claim 10, wherein the amplifying circuit amplifies the signal from the constant current driver circuit by increasing the resistance value of the second resistor.

12. The liquid crystal display apparatus as recited in claim 10, wherein the amplifying circuit amplifies the signal from the constant current driver circuit by reducing the resistance value of the first resistor.

13. The liquid crystal display apparatus as recited in claim 10, wherein the amplifying circuit amplifies the signal from the constant current driver circuit by increasing the resistance value of the second resistor and reducing the resistance value of the first resistor.

14. The liquid crystal display apparatus as recited in claim 10, wherein the boosting circuit includes an inductor, a MOS transistor, a rectifier diode, and a capacitor;

wherein one end of the inductor receives the direct current voltage; wherein the other end of the inductor connects to a positive electrode of the rectifier diode; wherein a drain of the MOS transistor is arranged between the inductor and the positive electrode of the rectifier diode;

wherein one end of the capacitor connects to a negative electrode of the rectifier diode and a positive electrode of the LED string; wherein the other end of the capacitor connects to a source of the MOS transistor; and wherein a gate of the MOS transistor connects to the other end of the first resistor in the amplifying circuit.

15. The liquid crystal display apparatus as recited in claim 14, wherein the constant current driver circuit includes an oscillator for generating a triangular wave signal;

a seventh resistor for limiting the frequency of the triangular wave signal;

a comparator for comparing the voltage of the triangular wave signal and the voltage of both ends of the sixth resistor in the LED string;

wherein when the voltage of the triangular wave signal is higher than the voltage of both ends of the sixth resistor in the LED string, an output terminal of the comparator outputs a first signal to the base of the first transistor in the amplifying circuit; and wherein when the triangular wave signal is lower than the voltage of both ends of the sixth resistor in the LED string, an output terminal of the comparator outputs a second signal to the base of the first transistor in the amplifying circuit.

16. The liquid crystal display apparatus as recited in claim 15, wherein the first signal is a high-level signal and the second signal is a low-level signal.

17. The liquid crystal display apparatus as recited in claim 10, wherein a frequency of the magnified signal output from the amplified circuit is identical to the frequency of the signal output from the constant current driver circuit, and the duty factor of the magnified signal output from the magnified circuit is also identical to a duty factor of the signal output from the constant current driver circuit.

18. The liquid crystal display apparatus as recited in claim 10, wherein the direct current voltage is converted from an external alternating current voltage which is outside of the liquid crystal display apparatus.

* * * * *